US006061048A

United States Patent [19]

Choi

[11] Patent Number: 6,061,048

[45] Date of Patent: May 9, 2000

[54] TECHNIQUE FOR AUTOMATICALLY CONTROLLING THE CENTERING OF MONITOR SCREEN

[75] Inventor: Chun-Geun Choi, Suwon, Rep. of Korea

[73] Assignee: SamSung Electronics Co., Ltd., Kyungki-do, Rep. of Korea

[21] Appl. No.: 08/917,840

[22] Filed: Aug. 27, 1997

[30] Foreign Application Priority Data

Aug. 27, 1996 [KR] Rep. of Korea ..... 96/35908

[51] Int. Cl.[7] ..... G09G 5/34

[52] U.S. Cl. ..... 345/121; 345/131

[58] Field of Search ..... 345/131, 132, 345/121, 127; 382/298

[56] References Cited

U.S. PATENT DOCUMENTS

| | | | |
|---|---|---|---|
| 4,574,279 | 3/1986 | Roberts | 340/731 |
| 4,754,270 | 6/1988 | Murauchi | 340/731 |
| 4,990,902 | 2/1991 | Zenda | 340/731 |
| 4,991,022 | 2/1991 | Canfield et al. | 358/180 |
| 5,335,296 | 8/1994 | Larkin et al. | 382/47 |
| 5,457,473 | 10/1995 | Arai et al. | 345/10 |
| 5,477,241 | 12/1995 | Higgins et al. | 345/127 |
| 5,508,714 | 4/1996 | Zenda | 345/3 |
| 5,555,002 | 9/1996 | Nguyen | 345/121 |
| 5,572,259 | 11/1996 | Nohara | 348/441 |
| 5,592,194 | 1/1997 | Nishikawa | 345/127 |
| 5,612,715 | 3/1997 | Karaki et al. | 345/132 |
| 5,621,428 | 4/1997 | King et al. | 345/118 |
| 5,648,795 | 7/1997 | Vouri et al. | 345/132 |
| 5,771,040 | 6/1998 | Kim | 345/213 |
| 5,781,185 | 7/1998 | Shin | 345/213 |
| 5,784,037 | 7/1998 | Inoue | 345/87 |
| 5,805,149 | 11/1998 | Yuki et al. | 345/202 |

*Primary Examiner*—Richard A. Hjerpe
*Assistant Examiner*—Marthe Y. Marc-Coleman
*Attorney, Agent, or Firm*—Robert E. Bushnell, Esq.

[57] ABSTRACT

In a monitor screen control apparatus which receives video and synchronizing signals from a host computer and automatically displays screen images in the middle of screen of a monitor regardless of computer-supported display modes, the automatic controlling of the centering of the monitor screen is achieved by a first control routine of transmitting mode data from a host computer to an associated monitor and a second control routine of receiving the mode data at the monitor. The second control routine has the step of calculating the screen position which includes calculating a horizontal position, a horizontal size, a vertical position, and a vertical size.

3 Claims, 9 Drawing Sheets

TECHNIQUE FOR AUTOMATICALLY CONTROLLING THE CENTERING OF MONITOR SCREEN

CLAIM OF PRIORITY

This application makes reference to, incorporates the same herein, and claims all benefits accruing under 35 U.S.C. §119 from an application for APPARATUS AND METHOD FOR AUTOMATICALLY CONTROLLING THE CENTERING OF MONITOR SCREEN earlier filed in the Korean Industrial Property Office on the $27^{th}$ of Aug. 1996 and there duly assigned Ser. No. 35908/1996.

BACKGROUND OF THE INVENTION

1. Field of the Invention

The present invention relates to a monitor screen control apparatus which receives video and synchronizing signals from a host computer and automatically displays screen images in the middle of screen of a monitor regardless of computer-supported display modes, and a method for automatically controlling the centering of the monitor screen.

2. Description of the Related Art

A computer monitor is provided to display text and/or graphic information from a host computer on the screen thereof. Such a computer monitor allows the display of screen images in accordance with display modes, such as a variety of text and graphic modes, which are supported by the host computer. For example, the computer monitor receives text information from the computer and displays it on the screen thereof with a text mode. The computer monitor also receives graphic information from the computer and displays it on the screen thereof with a graphic mode.

A typical personal computer may have an associated monitor serving as a display apparatus, a keyboard and a printer, a light pen or plotter. The monitor associated with the computer is connected to a graphic card, for instance, a VGA card of the computer via a video cable. The computer provides video signals, e.g., R(red), G(green) and B(blue) video signals, vertical and horizontal synchronization signals V_Sync and H_Sync, and overall control information required to control the monitor, to the monitor through the video cable. Also, through the video cable, information indicative of the monitor-processed results from the monitor are provided to the computer. The monitor has a monitor circuit and a CRT (cathode ray tube). Thus, the monitor displays video signals R, G and B on the CRT in synchronism with the vertical and horizontal synchronization signals which are supplied from the VGA card of the computer in accordance with the computer-supported display modes. The monitor, however, has a problem in that the image is not displayed in the middle of the monitor screen or partially displaced on the monitor in accordance with the display modes. Since the partially displaced image is beyond the range of the display on the screen, an operator cannot view the displaced image using the monitor.

The following patents each disclose features in common with the present invention but do not teach or suggest the specifically recited technique for automatically controlling the centering of a monitor screen as in the present invention: U.S. Pat. No. 5,555,002 to Nguyen, entitled Method And Display Control System For Panning, U.S. Pat. No. 5,572,259 to Nohara, entitled Method Of Changing Personal Computer Monitor Output For Use By A General Purpose Video Display, U.S. Pat. No. 5,621,428 to King et al., entitled Automatic Alignment Of Video Window On A Multimedia Screen, U.S. Pat. No. 4,991,022 to Canfield et al., entitled Apparatus And A Method For Automatically Centering A Video Zoom And Pan Display, U.S. Pat. No. 5,592,194 to Nishikawa, entitled Display Controller, U.S. Pat. No. 5,335,296 to Larkin et al., entitled Process For High Speed Rescaling Of Binary Images, U.S. Pat. No. 5,457,473 to Arai et al., entitled Image Display Apparatus, U.S. Pat. No. 5,477,241 to Higgins et al., entitled Method Of Resetting A Computer Video Display Mode, U.S. Pat. No. 4,990,902 to Zenda, entitled Display Area Control System For Flat Panel Display Device, U.S. Pat. No. 4,574,279 to Roberts, entitled Video Display System Having Multiple Selectable Screen Formats, and U.S. Pat. No. 4,754,270 to Murauchi, entitled Apparatus For Varying The Size And Shape Of An Image In A Raster Scanning Type Display.

SUMMARY OF THE INVENTION

The present invention is intended to solve the abovenoted problem and it is an object of the present invention to provide a monitor screen control apparatus for use with a host computer in which screen image information from the host computer are displayed in the middle of the monitor screen regardless of the computer-supported display modes.

According to an aspect of the present invention, a method of automatically controlling the centering of monitor screen, comprises the steps of determining whether or not mode data has been inputted from a host computer; determining, if the mode data has not been inputted, whether or not an initial display mode of a monitor has been changed to another display mode; determining, if the display mode has been changed, whether or not information corresponding to the changed display mode has been stored; transmitting, if the information has been stored, mode data from the host computer to the monitor; determining, if the mode data has been inputted, whether or not a display mode is designated; inputting the mode data corresponding to the designated display mode; determining whether a vertical synchronization signal contained in the mode data is at a predetermined level; receiving, if so, the mode data from the host computer; determining whether or not a start ID signal contained in the mode data has been detected; setting, if so, a mode modification flag; determining, if not, whether or not an end ID signal contained in the mode data has been detected; determining, if not, whether or not there is an index signal indicative of the type of the mode data in the mode data; storing, if so, the mode data in a memory; determining, if the end ID signal has been detected, whether or not a mode modification flag has been set; determining, if so, whether or not the mode data has been modified; calculating a screen position of screen images; and adjusting a screen position of the screen images.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENTS

Figure 1:
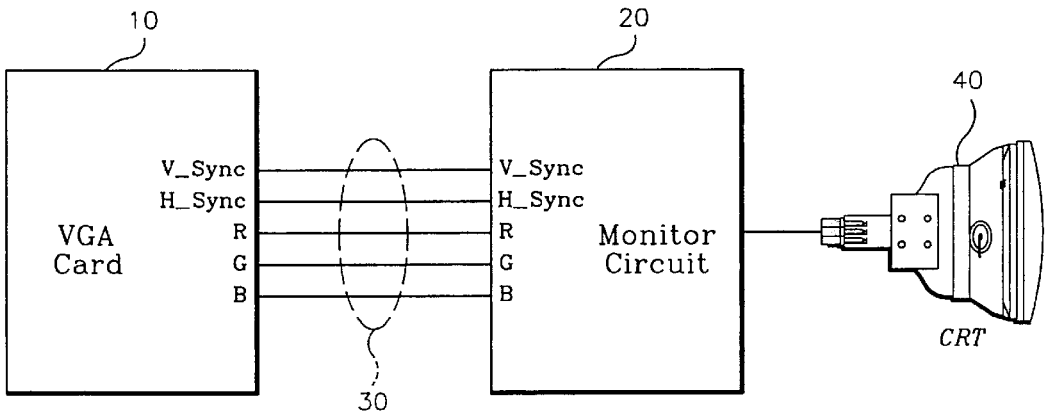
Fig. 1 (Prior Art)
FIG. 1 is a block diagram showing the combination of a VGA card of a host computer and a monitor circuit of an associated monitor.

FIG. 1 is a block diagram showing the combination of a VGA card of a host computer and a monitor circuit of an associated monitor as discussed above in the Description of the Related Art.

A personal computer 10 includes a graphic card, for example, a VGA card connected to a monitor circuit 20 via a video cable 30. The monitor circuit, contained in a monitor, is connected to a CRT (cathode ray tube) 40.

Figure 2:
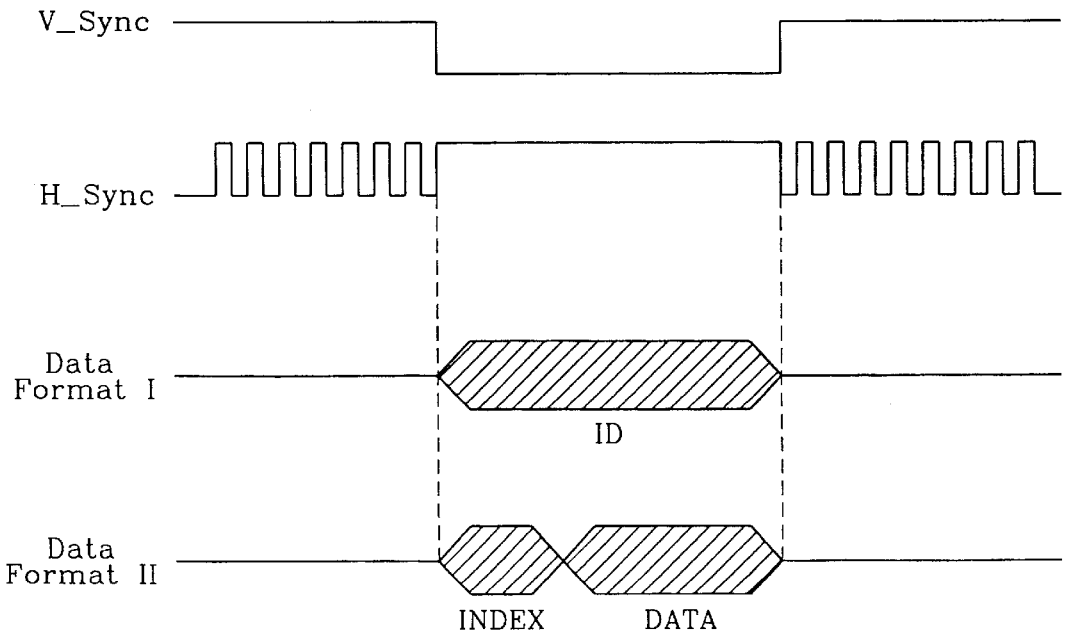
FIG. 2 is a timing chart showing signals supplied from the host computer to the monitor according to the present invention.

FIG. 2 is a timing chart showing signals supplied from a host computer to an associated monitor according to the present invention. In FIG. 2, V_Sync is a vertical synchronization signal, and H_Sync is a horizontal synchronization signal. A first data format I is comprised of an ID (identification) code of three bytes and a second data format II is comprised of, for instance, an index code of one byte and mode data of two bytes.

As shown again in FIG. 2, while the vertical synchronization signal V_Sync is at a low level, the mode data can be transmitted. Herein, the ID code indicates the start and the end of a data transmission. The transmitted data is comprised of two portions, an index portion and a mode data portion. Also, the data comprises display information corresponding to a variety of display modes which may be supported by the host computer. The transmitted data may be described by the following table 1.

TABLE 1

| INDEX VALUE | MODE DATA |
|---|---|
| 11 | Horizontal Period (H_Total) |
| 12 | Horizontal display area (H_Display) |
| 13 | Horizontal Sync Start (H_Sync_Start) |
| 14 | Horizontal Sync With (H_Sync_Width) |
| 21 | Vertical Period (V_Total) |
| 22 | Vertical display area (V_Display) |
| 23 | Vertical Sync Start (V_Sync_Start) |
| 24 | Vertical Sync With (V_Sync_Width) |

Figure 3:
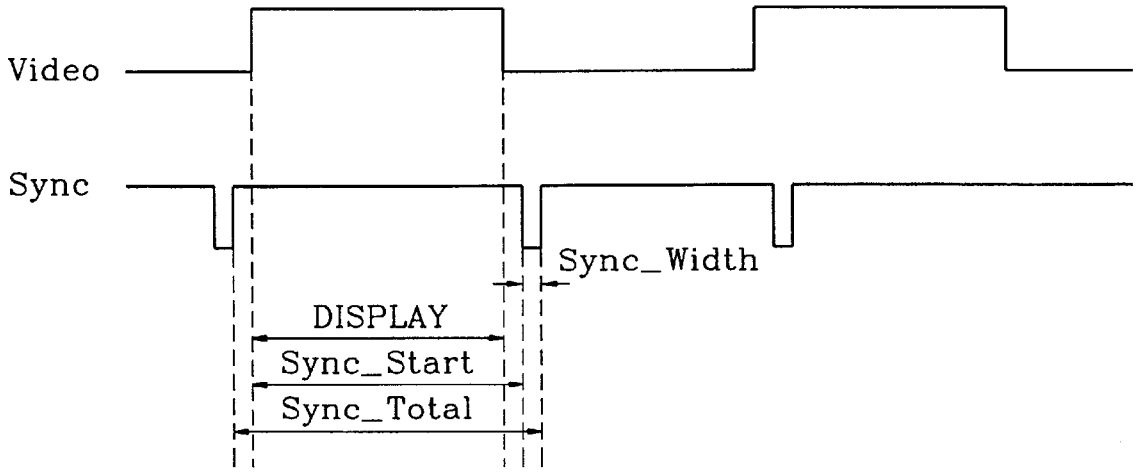
FIG. 3 is a timing chart explaining the timing between the video and synchronization signals supplied from the host computer to the monitor.

As shown in FIG. 3, H_display is a data interval of the horizontal synchronization display, V_display is a data interval of the vertical synchronization display, and Sync_Start is a data start interval of the horizontal or the vertical synchronization display. Sync_Total is a data interval of the horizontal or the vertical synchronization display, and Sync_Width is a data interval of the horizontal or the vertical synchronization pulse.

Figure 4:
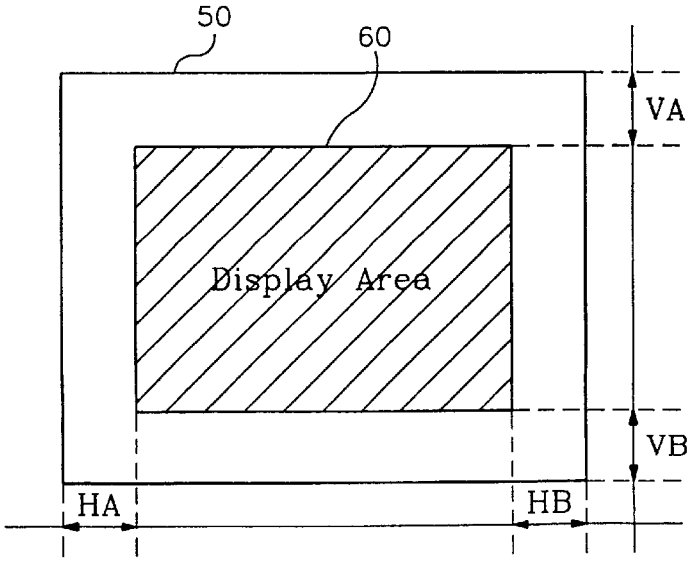
FIG. 4 is a plane view showing that a display area is positioned at the center point of the screen according to the present invention.

Also, as shown in FIG. 4, a reference numeral 50 indicates an overall area of the screen, and 60 is a screen area capable of being displayed by an operator. Reference symbol HA indicates a left margin interval of the screen, HB is a right margin interval thereof, VA is an upper margin interval thereof and VB is a lower margin interval thereof.

Hereinafter, it is illustrated as an example that the resolution of a display mode is 640 * 480, and horizontal and vertical synchronization signals have frequencies of 13.5 KHz and 60 Hz, respectively. It is also assumed that H_Total=100, H Display=80, H_Sync$_{13}$ Start=81, H_Sync_Width=12, V_Total=525, V_Display=480, V_Sync_Start=482, and V_Sync_Width=2. The left and right margin intervals HB and HA can be obtained by following equations (1) and (2).

$$HB=H_Sync_Start-H_Display=81-80=1 \quad (1)$$

$$HA=H_Total-H_Sync_Start-H_Sync_Width=100-81-12=7 \quad (2)$$

Also, the lower and upper margin intervals VB and VA can be obtained by following equations (3) and (4).

$$VB=V_Sync_Start-V_Display=482-480=2 \quad (3)$$

$$VA=V_Total-V_Sync_Start-V_Sync_Width=525-482-2=41 \quad (4)$$

Corrected horizontal position value can be obtained on the basis of a standard position value by following equation (5).

$$\begin{aligned} H_Position &= H_Pos + (((HA + HB)/2) \times 256/H_Total) \quad (5) \\ &= H_Pos + (4 * 256/100) = H_Pos + 10.24 \end{aligned}$$

wherein the value of 256 indicates variable steps capable of controlling the horizontal position of the monitor, H_Pos is a standard horizontal position when a horizontal front porch is equal to a horizontal back porch, and H_Position is a calculated horizontal position. The horizontal position H_Position is shifted from the designated position to 10~11 steps in a right direction during a horizontal scanning period. Also, the corrected value of the horizontal size H_Size can be obtained from the standard horizontal size and by the following equation (6).

$$\begin{aligned} H_Size &= H_Size_Std + \quad (6) \\ &\quad (1 - (H_Display/(H_Total - H_Sync_Width)) * 256 \\ &= H_Size_Std + (1 - 0.909) * 256 \\ &= H_Size_Std + 23.3 \end{aligned}$$

wherein the value of 256 indicates variable steps capable of controlling the horizontal size of the monitor, H_Size_Std is a standard screen size which is given in designing the monitor. The horizontal size H_Size is determined by adding 23~24 steps to the standard horizontal size in order that screen image can be displayed in the range of about 90.9% on screen.

Also, the corrected vertical position value can be obtained on the basis of a standard position value by the following equation (7).

$$\begin{aligned} V_Position &= V_Pos + (((VA + VB)/2) \times 256/V_Total) \quad (7) \\ &= V_Pos + (21.5 * 256/525) = V_Pos + 10.5 \end{aligned}$$

wherein the value of 256 indicates variable steps capable of controlling the vertical position of the monitor, V_Pos is a standard vertical position when a vertical front porch is equal to a vertical back porch, and V_Position is a calculated vertical position.

The vertical position V_Position is shifted from the standard position to 10~11 steps in a bottom direction during a vertical scanning period. Also, the corrected value of the vertical size V_Size can be obtained from the standard vertical size and by the following equation (8).

$$\begin{aligned} V_Size &= V_Size_Std + \\ &\quad (1 - (V_Display / (V_Total - V_Sync_Width)) * 256 \\ &= V_Size_Std + (1 - 0.918) * 256 \\ &= V_Size_Std + 21.05 \end{aligned} \tag{8}$$

wherein the value of 256 indicates variable steps capable of controlling the vertical size of the monitor, V_Size_Std is a standard screen size which is given in designing the monitor. Thus, the vertical size V_Size is determined by adding 21~22 steps to the standard vertical size in order that screen image can be displayed within the range of about 91.8% on the screen during the vertical scanning period.

Figure 5:
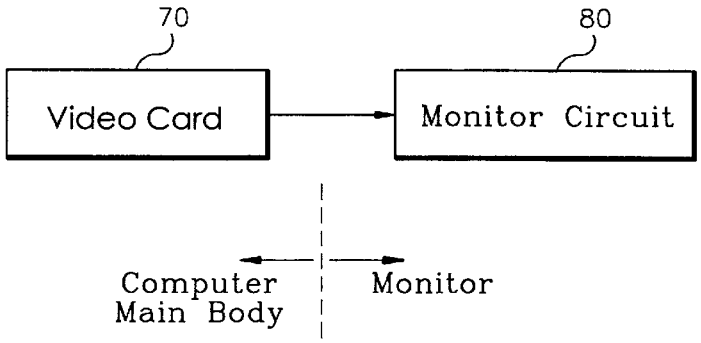
FIG. 5 is a block diagram showing a monitor screen control apparatus according to the present invention.
Figure 6:
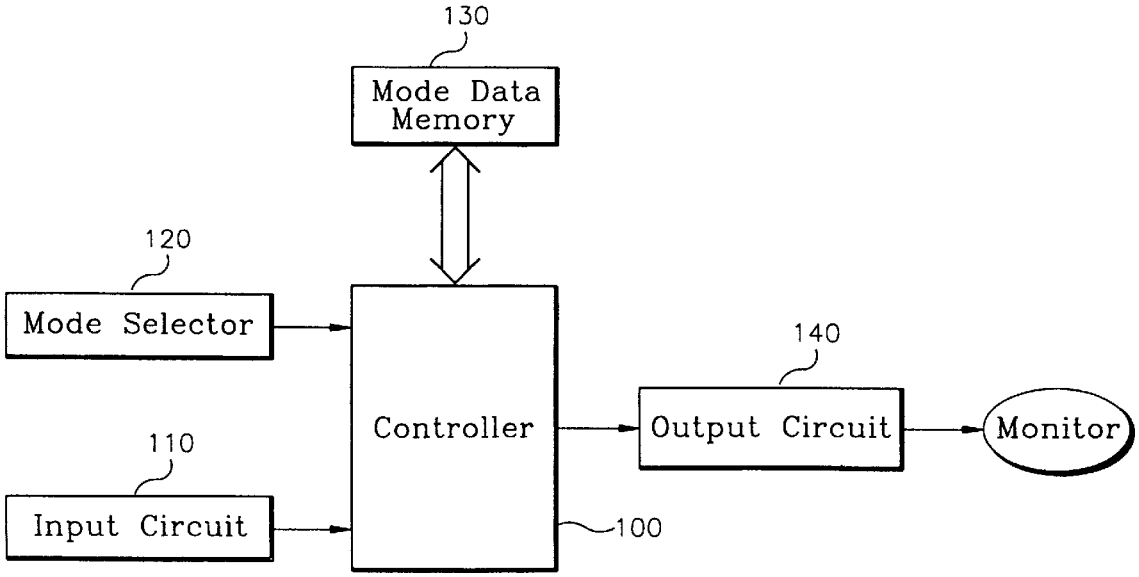
FIG. 6 is a detailed circuit diagram showing the video card shown in FIG. 5.
Figure 7:
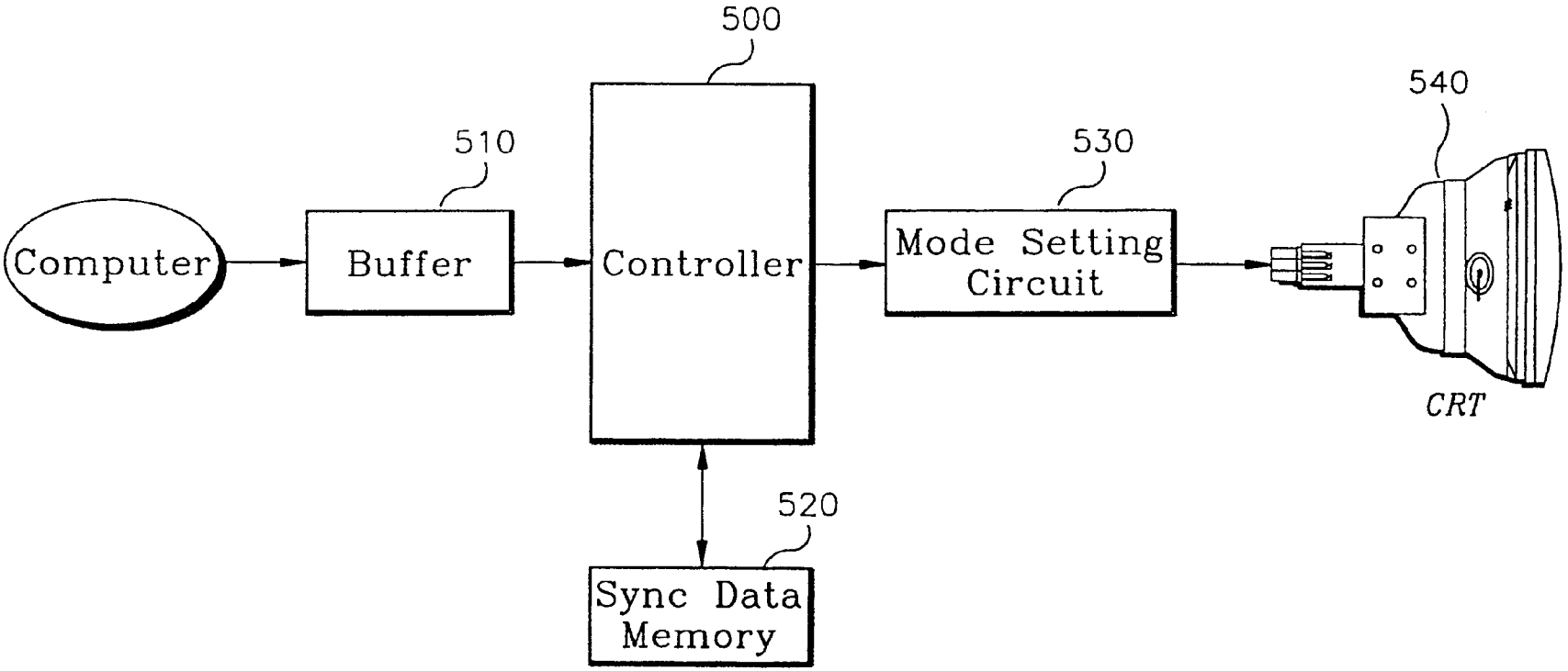
FIG. 7 is a detailed circuit diagram showing the monitor circuit shown in FIG. 5.

Referring to FIGS. 5 to 7, a novel monitor screen control apparatus has two main sections, one of which is a video card 70 located in a host computer, or a computer main body to provide video and synchronization signals in accordance with computer-supporting display modes, and the other of which is a monitor circuit 80 located in a monitor to automatically display images in the middle of the monitor screen regardless of the computer-supporting display modes. These computer-supporting display modes may be substantially changed depending on applications which are installed in the host computer. With the monitor screen control apparatus of the invention, the size and the starting position of the display area can be arbitrarily adjusted.

The video card 70 comprises, as shown in FIG. 6, an input circuit 10, or an input port for inputting mode data from a main board of the host computer, a controller 100 for controlling operations of the video card 70, a mode data memory 130 for storing the mode data by means of the controller 100, a mode selector 120 which has programs for controlling the operations of the controller 100 in response to the computer-supported display modes, for selectively performing the display modes, and an output circuit 140, or an output port for providing the mode data read out of the memory 130 to the monitor. Herein, the mode data means display information corresponding to the text or the graphic mode, and also includes screen information to be displayed on the monitor screen.

Also, the monitor circuit 80 comprises, as shown in FIG. 7, a controller 500 for controlling operations of the monitor circuit, a buffer 510 for receiving the mode data from the host computer, a memory 520 for storing a synchronization signal under the control of the controller 500 corresponding to the mode data received thus, and a mode setting circuit 530 for providing synchronization signals corresponding to the discriminated display mode to the monitor. The controller 500 is also provided for discriminating the types of display modes on the basis of the synchronization from the host computer and for generating a frequency signal corresponding to the discriminated display mode to be provided to the mode setting circuit 530. Thus, the mode setting circuit 530 generates synchronization signals necessary for the monitor in response to the frequency signal from the controller 500.

The mode data memory 130 of the video card 70 has a plurality of memories, such as a horizontal period memory, a horizontal display area memory, a horizontal synchronization start memory, a horizontal synchronization width memory, a vertical period memory, a vertical display area memory, a vertical synchronization start memory, and a vertical synchronization width memory. The horizontal period memory is provided for storing a horizontal period H_Total between the starting points of the horizontal synchronization signal and the following horizontal synchronization signal. The horizontal display area memory is provided for storing a display width H_Display corresponding to the interval of video signals during a horizontal synchronization period. The horizontal synchronization start memory stores a signal H_Sync_Start between the starting and ending points of the video signal interval. The horizontal synchronization width memory stores a pulse width H_Sync_Width of the horizontal synchronization signal. The vertical period memory stores a vertical period V_Total between the starting point of the vertical synchronization signal and the starting point of the following vertical synchronization signal. The vertical display area memory stores a display width V_Display corresponding to the interval of video signals during a vertical synchronization period. The vertical synchronization start memory stores a signal V_Sync_Start between the starting and ending points of the video signal interval. The vertical synchronization width memory stores a pulse width V_Sync_Width of the vertical synchronization signal.

Also, in addition to the above-described memories, the memory 520 of the monitor circuit 80 has additional memories, such as a horizontal size memory for storing a horizontal size of display image, a horizontal position memory for storing a horizontal position thereof, a vertical size memory for storing a vertical thereof, and a vertical position memory for storing a vertical position thereof.

Hereinafter, the method for automatically controlling the centering of monitor screen according to the present invention will be described in detail with reference to FIGS. 8 through 12. The method is achieved by two main steps, one of which is a first control routine of transmitting mode data from a host computer to an associated monitor and the other of which is a second control routine of receiving the mode data at the monitor. First, the first control routine to be executed in the controller 100 of the video card (shown in FIG. 6) will be described with reference to FIGS. 8 and 9.

Figure 8:
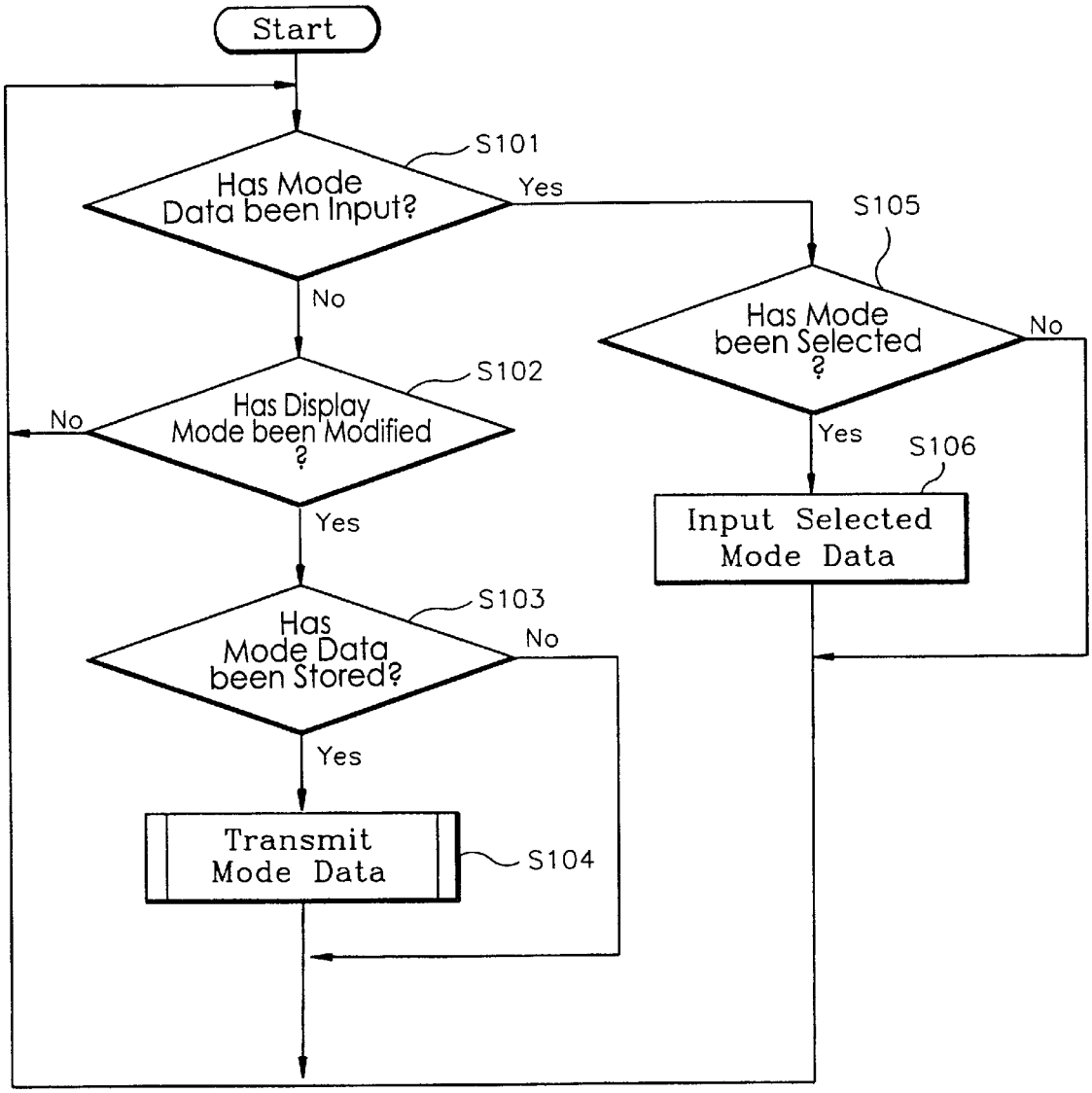
FIGS. 8 through 12 are flowcharts showing a method for controlling the monitor screen in the monitor shown in FIG. 7.

Referring to FIG. 8, the controller 100, at step S101, determines whether or not mode data has been inputted by the input circuit 110. If the mode data has not been inputted, the control proceeds to step S102, wherein the controller 100 determines whether or not an initial display mode of the monitor has been changed to one of the other display modes.

At step S102, if the display mode has been changed, the control proceeds to step S103 wherein the controller 100 determines whether or not information corresponding to the changed display mode has been stored in the mode data memory 130 (shown in FIG. 6). If so, the control proceeds to step S104 wherein a mode data transmitting routine is executed. For example, at step S104, the stored mode data is read out of the mode data memory 130 and transmitted to the monitor.

On the other hand, at step S101, if the mode data has been inputted by the input circuit 110, the control proceeds to step S105 wherein the controller 100 determines whether or not a display mode has been designated by the mode selector 120 (shown in FIG. 6). If so, the mode data corresponding to the designated display mode may be inputted by the input circuit 110. The execution of the mode data transmitting routine will be described with reference to FIG. 9.

Figure 9:
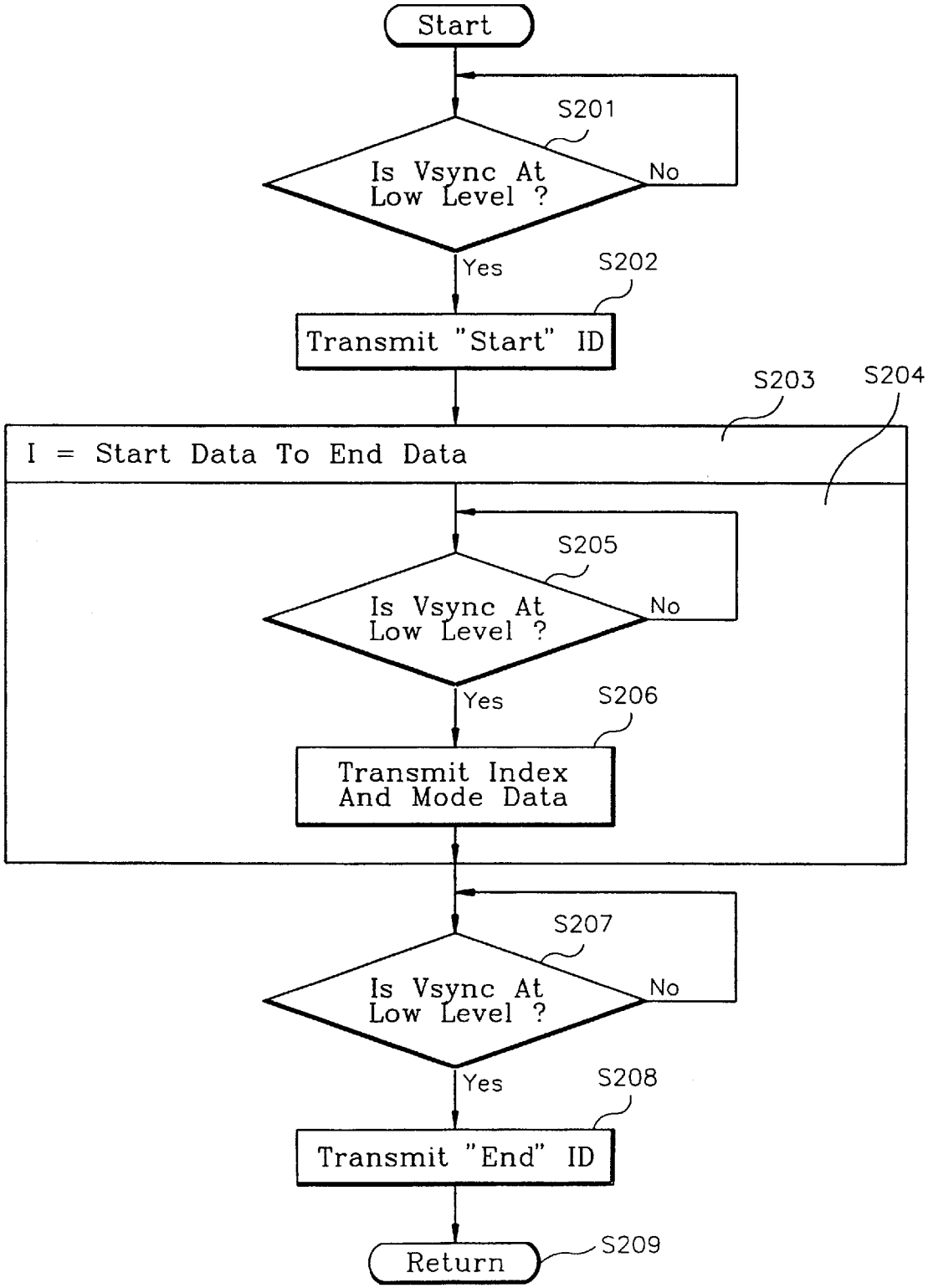

As shown in FIG. 9, at step S201, it is determined whether or not a vertical synchronization signal V_Sync is at low level so as to transmit data formatted as shown in FIG. 2 from the host computer to the monitor during a V_Sync of a low level. If V_Sync is at low level, the control proceeds to step S202 wherein a "SND" ID signal of three bytes indicative of the start of data transmission is first transmitted to the monitor.

Subsequently, through steps S203~S206, the mode data from the beginning to the end is sequentially transmitted to the monitor. For example, data transmission is initialized at step S203, and then it is determined at step S205 whether V_Sync is at low level. If so, the mode data continues to be sequentially transmitted. Herein, each of the mode data is comprised of information of three bytes, an index portion of one byte and a data portion of two bytes.

After the above steps, if all of the mode data has been completely transmitted, the control proceeds to step S207 wherein it is determined whether V_Sync is at low level. If so, an "END" ID signal of three bytes indicative of the end of data transmission is transmitted at step S208.

The first control routine to be executed in the controller 500 of the monitor circuit (shown in FIG. 7) will be described with reference to FIGS. 10 through 13.

Figure 10:
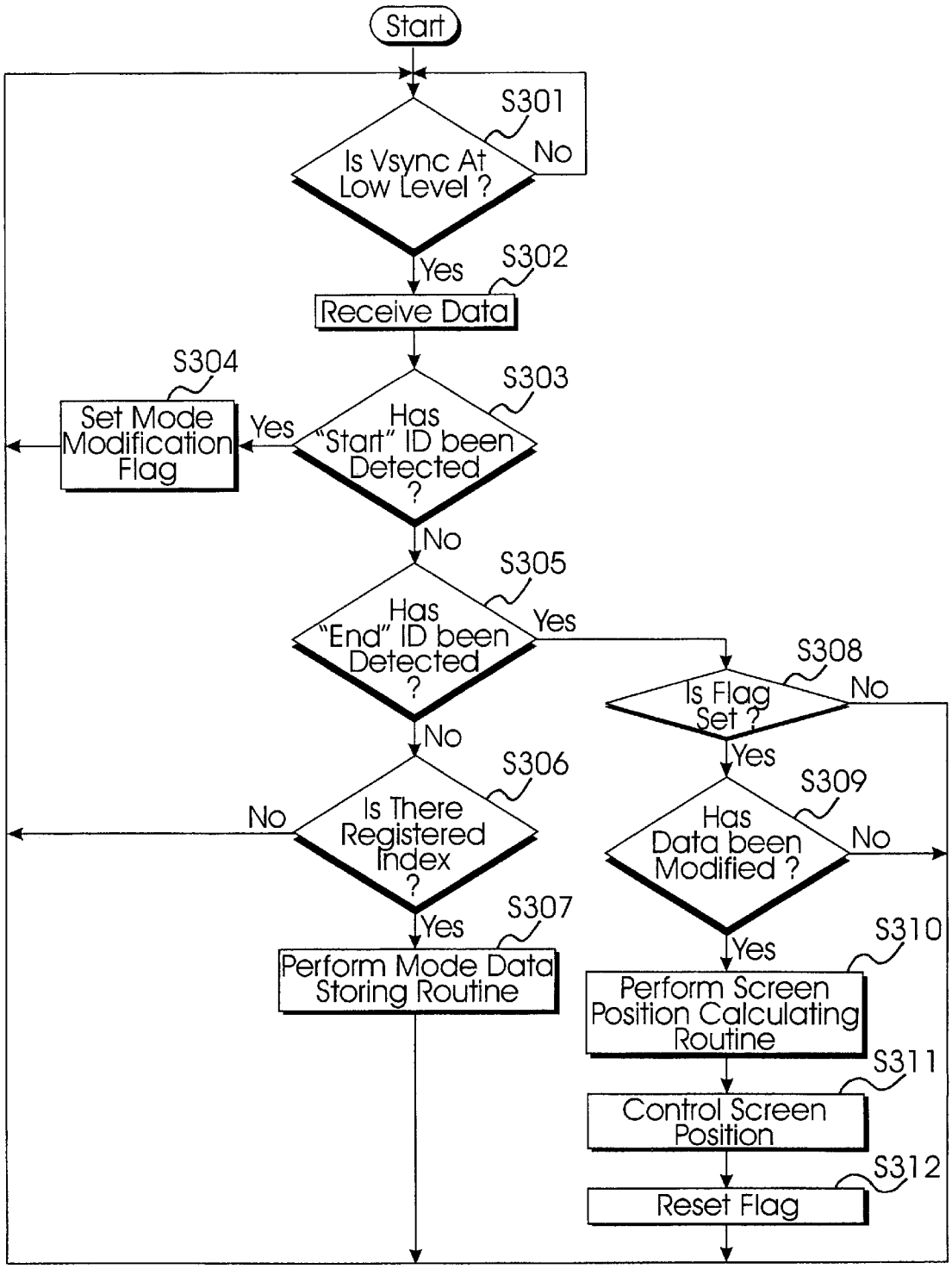

Referring to FIG. 10, the controller 500, at step S301, determines whether the vertical synchronization signal V_Sync is at a low level. If so, the control proceeds to step S302, wherein the controller 100 receives the data from the host computer.

At step S303, it is determined whether the "SND" signal from the host computer has been detected. If so, the control proceeds to step S304 wherein a mode modification flag is set to a logical "1". If not, the control proceeds to step S305 wherein it is determined whether the "END" signal from the host computer has been detected. Also, at step S306, it is determined whether there is a registered index signal. As a result, the operation for receiving the mode data continues to be transmitted until the "END" signal is detected. If there is the registered index signal at step S306, the control proceeds to step S307 wherein a mode data storing routine is performed. The index signal indicates the type of mode data.

On the other hand, if the "END" ID signal is detected at step S305, the control proceeds to step S308 wherein it is determined whether the mode modification flag has been set. If so, the controller 500 determines whether the mode data received thus has been modified at step S309.

If the received mode data has been modified, the control proceeds to step S310 wherein a routine for calculating a screen position is performed. Next, at step S311, the screen position to be displayed on the screen of the monitor is adjusted on the basis of the calculated screen position. Finally, the mode modification flag is reset at step S312.

Figure 11:
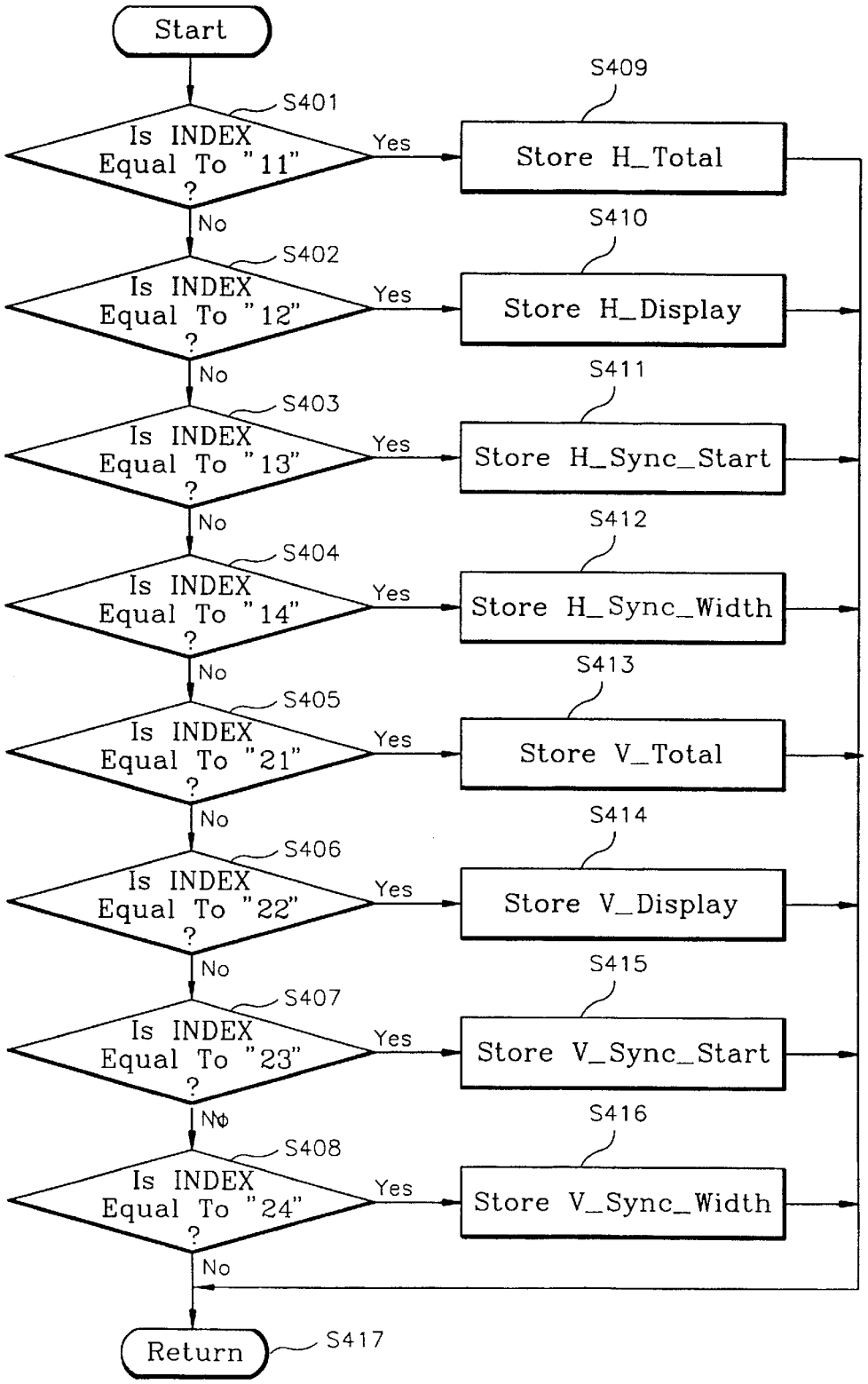

The mode data storing routine to be executed at step S307 will be described with reference to FIG. 11.

At steps S401 to S404, information regarding horizontal synchronization is detected in accordance with a value of the index signal indicating the type of mode data. For example, if the index value is equal to "11" indicative of horizontal period H_Total, the horizontal period value is stored in the horizontal period memory at step S409. If the index value is equal to "12" indicative of a horizontal display area H_Display, the horizontal display area value is stored in the horizontal display area memory at step S410. If the index value is equal to "13" indicative of the start of horizontal synchronization signal H_Sync_Start, the horizontal synchronization start value is stored in the memory at step S411. If the index value is equal to "14" indicative of the width of horizontal synchronization, the width value is stored in the memory at step S412.

Subsequently, at steps S405 to S408, information regarding vertical synchronization is detected in accordance with a value of the index signal indicating the type of mode data. For example, if the index value is equal to "21" indicative of vertical period V_Total, the vertical period value is stored in the vertical period memory at step S413. If the index value is equal to "22" indicative of a vertical display area V_Display, the vertical display area value is stored in the vertical display area memory at step S414. If the index value is equal to "23" indicative of the start of vertical synchronization signal V_Sync_Start, the vertical synchronization start value is stored in the memory at step S415. If the index value is equal to "24" indicative of the width of vertical synchronization, the width value is stored in the memory at step S416.

Figure 12:
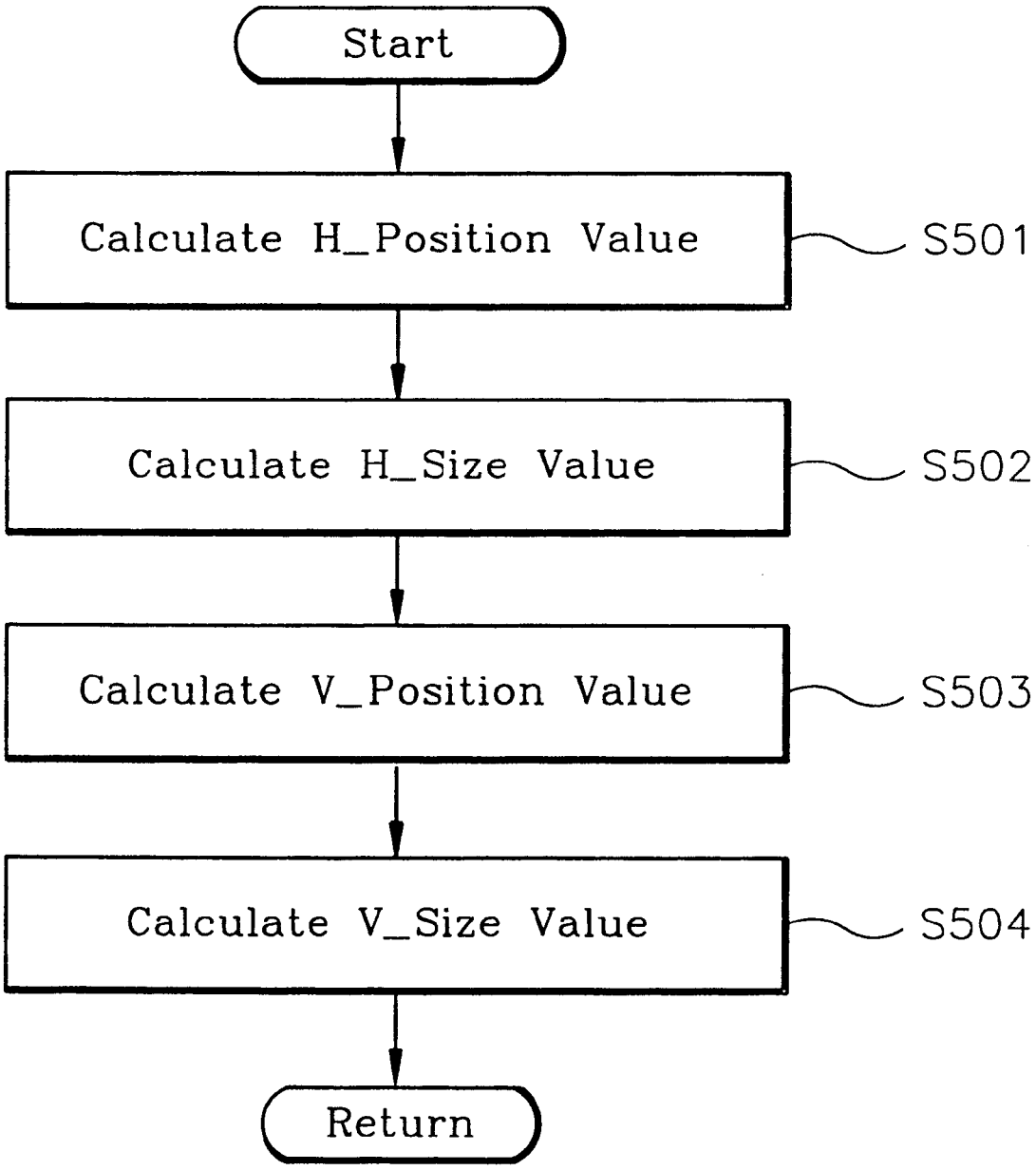

The screen position calculating routine to be executed at step S310 will be described with reference to FIG. 12.

First, at step S501, the horizontal position H_Position is calculated on the basis of the above described equation (5) and stored in the horizontal position memory. At step S502, the horizontal size H_Size is calculated on the basis of the above described equation (6) and stored in the horizontal size memory.

Next, at step S503, the vertical position V_Position is calculated on the basis of the above described equation (7) and stored in the vertical position memory. At step S504, the vertical size V_Size is calculated on the basis of the above described equation (8) and stored in the vertical size memory.

As described above, according to a method for controlling monitor screen of the present invention, screen images can be displayed in the middle of the monitor screen regardless of computer-supported display modes. Therefore, an operator can accurately view the images without the partial displacement of images on the screen.

Also, the size and the starting position of display area according to the computer-supported display modes may be arbitrarily adjusted.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A method of automatically controlling the centering of monitor screen, comprising the steps of:

determining whether or not mode data has been inputted from a host computer;

determining, if the mode data has not been inputted, whether or not an initial display mode of a monitor has been changed to another display mode;

determining, if the display mode has been changed, whether or not information corresponding to the changed display mode has been stored;

transmitting, if the information has been stored, mode data from the host computer to the monitor;

determining, if the mode data has been inputted, whether or not a display mode has been designated;

inputting the mode data corresponding to the designated display mode;

determining whether a vertical synchronization signal contained in the mode data is at a predetermined level;

receiving, if so, the mode data from the host computer;

determining whether or not a start ID signal contained in the mode data has been detected;

setting, if so, a mode modification flag;

determining, if not, whether or not an end ID signal contained in the mode data has been detected;

determining, if not, whether or not there is an index signal indicative of mode data type in the mode data;

storing, if so, the mode data in a memory;

determining, if the end ID signal has been detected, whether or not a mode modification flag has been set;

determining, if so, whether or not the mode data has been modified;

calculating a screen position of screen images; and adjusting a screen position of the screen images;

the steps of calculating the screen position comprising the steps of:

calculating a corrective horizontal position on the basis of a standard position value using the following equation:

$$H_Position=H_Pos+(((HA+HB)/2)\times 256/H_Total)$$

wherein H_Pos is a standard horizontal position where a horizontal front porch is equal to a horizontal back porch and HA is a left margin interval of the screen and HB is a right margin interval and H_Total is a horizontal period and 256 is a number of variable steps;

calculating a horizontal size using the following equation:

$$H_Size=H_Size_Std+(1-(H_Display/(H_Total-H_Sync_Width))*256$$

wherein H_Size_Std is a standard screen size and H_Display is a horizontal display area and a H_Sync_Width is a horizontal sync width;

calculating a vertical position using the following equation:

$$V_Position=V_Pos+(((VA+VB)/2)\times 256/V_Total$$

wherein V_Pos is a standard vertical position where a vertical front porch is equal to a vertical back porch and VA is an upper margin interval of the screen and VB is a lower margin interval of the screen and V_Total is a vertical period: and calculating a vertical size using the following equation:

$$V_Size=V_Size_Std+(1-(V_Display/V_Total-V_Sync_Width))*256$$

wherein V_Size_Std is a standard screen size and V_Display is a vertical display area and V_Total is a vertical period and V_Sync_Width is a vertical sync width.

2. The method according to claim 1, the step of transmitting the mode data from the host computer to the monitor comprising the steps of:

determining whether or not the vertical synchronization signal is at a predetermined level;

transmitting, if so, the start ID signal to the monitor; and transmitting the mode data until the end ID signal has been detected.

3. The method according to claim 2, the step of storing the mode data in the memory comprising the steps of:

determining whether information regarding horizontal synchronization has been detected in accordance with the index signal indicating the type of mode data; and storing the detected information in corresponding memories.

* * * * *